US009061844B2

(12) United States Patent
Takahashi

(10) Patent No.: US 9,061,844 B2
(45) Date of Patent: Jun. 23, 2015

(54) SHEET CONVEYING APPARATUS AND IMAGE FORMING APPARATUS FOR CORRECTING SKEW OF A SHEET

(71) Applicant: CANON KABUSHIKI KAISHA, Tokyo (JP)

(72) Inventor: Masafumi Takahashi, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/335,658

(22) Filed: Jul. 18, 2014

(65) Prior Publication Data

US 2015/0028532 A1 Jan. 29, 2015

(30) Foreign Application Priority Data

Jul. 23, 2013 (JP) ..... 2013-152793

(51) Int. Cl.

| | |
|---|---|
| ***B65H 5/34*** | (2006.01) |
| ***B65H 9/00*** | (2006.01) |
| ***B65H 7/00*** | (2006.01) |
| ***B65H 3/06*** | (2006.01) |
| ***B65H 5/06*** | (2006.01) |
| ***B65H 7/06*** | (2006.01) |
| ***B65H 9/04*** | (2006.01) |
| ***B65H 9/06*** | (2006.01) |
| ***B65H 9/14*** | (2006.01) |
| ***B65H 29/68*** | (2006.01) |

(52) U.S. Cl.

CPC ..... *B65H 9/004* (2013.01); *B65H 7/00* (2013.01); *B65H 3/0676* (2013.01); *B65H 5/062* (2013.01); *B65H 7/06* (2013.01); *B65H 9/002* (2013.01); *B65H 9/006* (2013.01); *B65H 9/04* (2013.01); *B65H 9/06* (2013.01); *B65H 9/14* (2013.01); *B65H 2301/331* (2013.01); *B65H 2301/512125* (2013.01); *B65H 29/68* (2013.01); *B65H 5/34* (2013.01); *B65H 2513/10* (2013.01)

(58) Field of Classification Search

CPC ..... B65H 5/062; B65H 7/00; B65H 9/00; B65H 9/004; B65H 9/04; B65H 9/06; B65H 9/14; B65H 2301/331; B65H 2301/5121; B65H 2301/51212; B65H 2301/512125; B65H 5/00; B65H 29/68; B65H 2513/10; B65H 5/34

See application file for complete search history.

(56) References Cited

U.S. PATENT DOCUMENTS

| | | | | |
|---|---|---|---|---|
| 2002/0076250 | A1* | 6/2002 | Johnson et al. | 400/630 |
| 2005/0206072 | A1* | 9/2005 | Tanabe | 271/226 |
| 2008/0251998 | A1* | 10/2008 | Muneyasu et al. | 271/227 |
| 2011/0316226 | A1* | 12/2011 | Karikusa et al. | 271/226 |

FOREIGN PATENT DOCUMENTS

| | | | |
|---|---|---|---|
| JP | 6-336353 | A | 12/1994 |
| JP | 9-183539 | A | 7/1997 |

* cited by examiner

*Primary Examiner* — Prasad Gokhale

(74) *Attorney, Agent, or Firm* — Canon USA, Inc., IP Division

(57) ABSTRACT

A sheet conveying apparatus forms a loop of a sheet between a first conveyance roller pair and a second conveyance roller pair, and before a leading edge of the sheet reaches a nip portion of a third conveyance roller pair, separates the first conveyance roller pair.

11 Claims, 11 Drawing Sheets

SHEET CONVEYING APPARATUS AND IMAGE FORMING APPARATUS FOR CORRECTING SKEW OF A SHEET

BACKGROUND OF THE INVENTION

1. Field of the Invention

The present invention relates to a sheet conveying apparatus capable of correcting a skew of a sheet and an image forming apparatus having the sheet conveying apparatus.

2. Description of the Related Art

In conventional image forming apparatuses for forming an image on a sheet, in order to form the image without a skew onto the sheet, a sheet conveying apparatus capable of correcting the skew of the sheet conveyed to an image forming unit is provided.

The configurations discussed in Japanese Patent Application Laid-Open No. 6-336353 and Japanese Patent Application Laid-Open No. 9-183539, a skew of a sheet is corrected by bringing the leading edge of the sheet into contact with a contact portion such as a nip portion of a registration roller pair and a shutter so as to form a loop of the sheet and to make the leading edge of the sheet fit along the nip portion.

In recent image forming apparatuses, there has been growing demands for forming an image onto various types of sheets of different sizes, different grammage, and different surface glossiness with enhanced productivity with a more compact body. Unfortunately, the conventional sheet conveying apparatuses have been in need of some improvements in achieving the high productivity while maintaining the skew correction performance for the various types of sheets.

For example, in conveying a sheet of a large grammage (so-called thick paper), since the sheet stiffness is large, the sheet slips at the nip portion of the roller pair provided upstream of the above-described contact portion when correcting the skew of the sheet. This may cause failure in the formation of the sheet loop of a desired size required to correct the skew of the sheet. If the sheet loop of the desired size cannot be formed, the skew of the sheet cannot be corrected. As a result, the image cannot be formed at an appropriate position on the sheet, causing an image failure. In consideration of the slip, if the loop formation is continued until the loop of a predetermined size is formed, the productivity may be significantly decreased. In other words, for the thick paper, the conventional sheet conveying apparatuses have not been able to achieve sufficient skew correction performance while maintaining high productivity.

SUMMARY OF THE INVENTION

The present invention is directed to a sheet conveying apparatus capable of correcting a skew for various types of sheets without decreasing productivity.

According to an aspect of the present invention, a sheet conveying apparatus includes a first conveyance roller pair configured to convey a sheet, a second conveyance roller pair disposed upstream of the first conveyance roller pair and configured to convey the sheet, a contact portion disposed downstream of the first conveyance roller pair and configured to contact the conveyed sheet, a third conveyance roller pair disposed downstream of the first conveyance roller pair and configured to convey the sheet with a skew having been corrected by contacting the contact portion, a separation unit configured to separate the first conveyance roller pair, and a control unit configured to control a conveyance speed of the sheet conveyed by the first conveyance roller pair, a conveyance speed of the sheet conveyed by the second conveyance roller pair, and the separation unit, wherein the control unit forms a loop of the sheet between the first conveyance roller pair and the second conveyance roller pair, and separates the first conveyance roller pair before a leading edge of the sheet reaches the contact portion.

Further features of the present invention will become apparent from the following description of exemplary embodiments with reference to the attached drawings.

DESCRIPTION OF THE EMBODIMENTS

Figure 9:
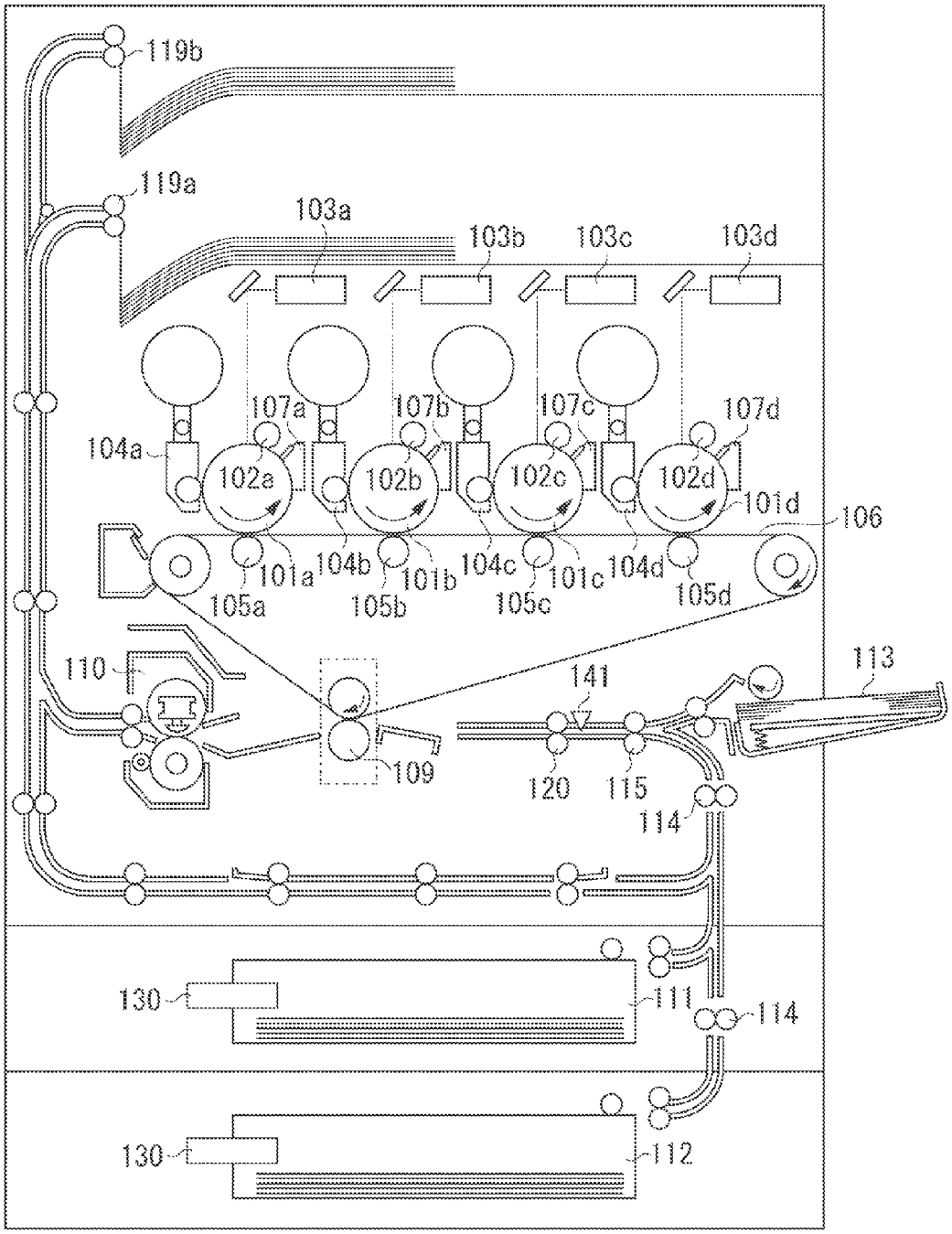
FIG. 9 illustrates an image forming apparatus to which a sheet conveying apparatus according to an exemplary embodiment of the present invention is applied.

Various exemplary embodiments, features, and aspects of the invention will be described in detail below with reference to the drawings. FIG. 9 is a cross-sectional view schematically illustrating a color digital printer that serves as an example of an image forming apparatus to which a sheet conveying apparatus according to an exemplary embodiment of the present invention is applied.

First, an image forming unit will be described. The surfaces of four photosensitive drums 101*a* to 101*d* are uniformly charged by charging rollers 102*a* to 102*d*, respectively. To laser scanners 103*a* to 103*d*, image signals of yellow (Y), magenta (M), cyan (C), and black (B) are respectively input. According to the image signals, the drum surfaces are irradiated with laser beams, the electric charge is neutralized, and latent images are formed.

The latent images formed on the photosensitive drums 101*a* to 101*d* are developed with toner of yellow, magenta, cyan, and black by development units 104*a* to 104*d*, respectively. The toner developed on the respective photosensitive drums is sequentially transferred onto an intermediate transfer belt 106 that serves as an endless belt-shaped image bearing member by primary transfer rollers 105*a* to 105*d*. In this way, on the intermediate transfer belt 106, a full-color toner image is formed.

A sheet fed from any one of sheet feeding units including sheet cassettes 111 and 112, and a manual sheet feeding unit 113 is conveyed toward a third conveyance roller pair (registration roller pair) 120 by a second conveyance roller pair 114 and a first conveyance roller pair 115. The toner image on the intermediate transfer belt 106 is controlled so that no deviation occurs between the sheet conveyed by the third conveyance roller pair 120 and the image. The toner image is transferred onto the sheet by a secondary transfer outer roller 109. The toner image is then heated and pressed by a fixing device 110 and fixed onto the sheet. Thereafter, the sheet is discharged from a discharge unit 119*a* or 119*b* to the outside of the apparatus main unit.

Figure 4:
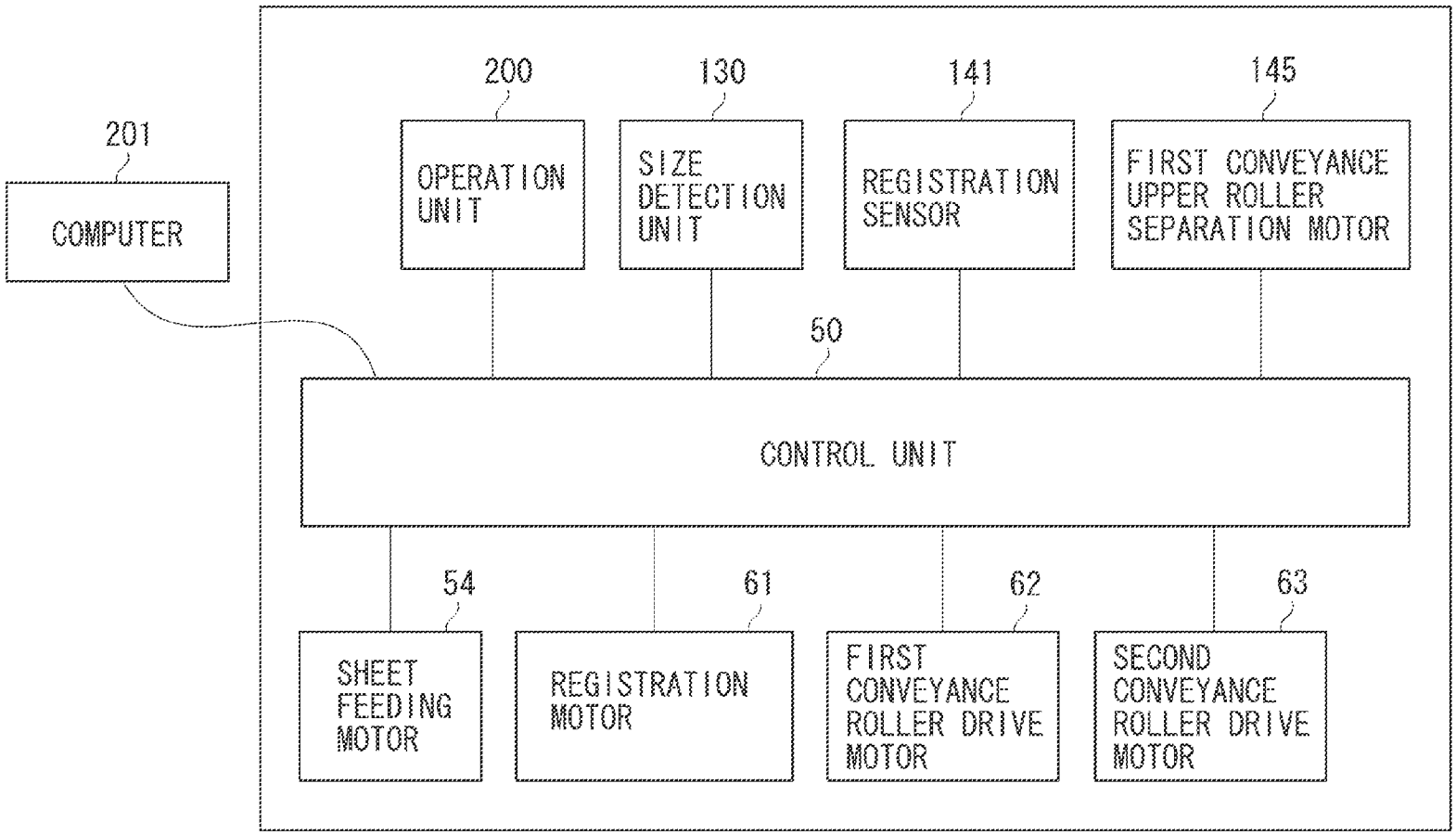
FIG. 4 is a block diagram illustrating an image forming apparatus according to an exemplary embodiment of the present invention.

From an operation unit 200 (illustrated in FIG. 4) provided in the image forming apparatus, a user can input various types of information about sheets (for example, size information, grammage information, and information about surface properties) to a control unit 50 described below. Further, the user can input various types of information about sheets to the control unit 50 described below from a computer 201 connected to the image forming apparatus via a network.

Each of the sheet cassettes 111 and 112 includes a size detection unit 130 for detecting a size of a stored sheet and notifying the below-described control unit 50 of the image forming apparatus of the detected size. The size detection unit 130 includes a size detection lever that slides and comes in contact with a side regulating plate for regulating the position of the sheet in the width direction. The side detection lever can rotate in conjunction with the side regulating plate.

The size detection unit 130 includes a plurality of sensors or switches in an attachment portion in the apparatus main body to which the sheet cassette is to be attached. The sensors or switches are provided at positions corresponding to the size detection lever. If the user moves the side regulation plate to fit it to the side end portion of the sheet, the size detection lever rotates in conjunction with the movement. In response to the sheet cassette being attached to the image forming apparatus, the side detection lever selectively turns on or off detection elements of the sensors or the switches provided in the attachment portion of the apparatus main body. With this operation, signals of different patterns are sent from the sensors or switches to the image forming apparatus main body. Based on the signals, the information processing apparatus main body can recognize the size of the sheet stored in the sheet cassette. The manual sheet feeding unit 113 may be provided with a similar mechanism to the foregoing, as a size detection unit.

The side regulation plate can be moved along the side end portion of the sheet. This enables position adjustment of the sheet in the width direction with respect to the image forming unit. The side regulation plate is also effective to prevent a sheet skew caused during the sheet feeding operation at the conveyance rollers provided downstream of the sheet feeding rollers. In actual operations, however, a small space between the side regulation plate and the sheet may cause a skew of the sheet. In another case, the sheet conveyed from the sheet feeding unit may be skewed during the sheet conveyance operation.

To solve the problems, an image forming apparatus according to a first exemplary embodiment includes a sheet conveying apparatus 116 capable of correcting a skew of a sheet fed to the image forming unit.

Figure 1:
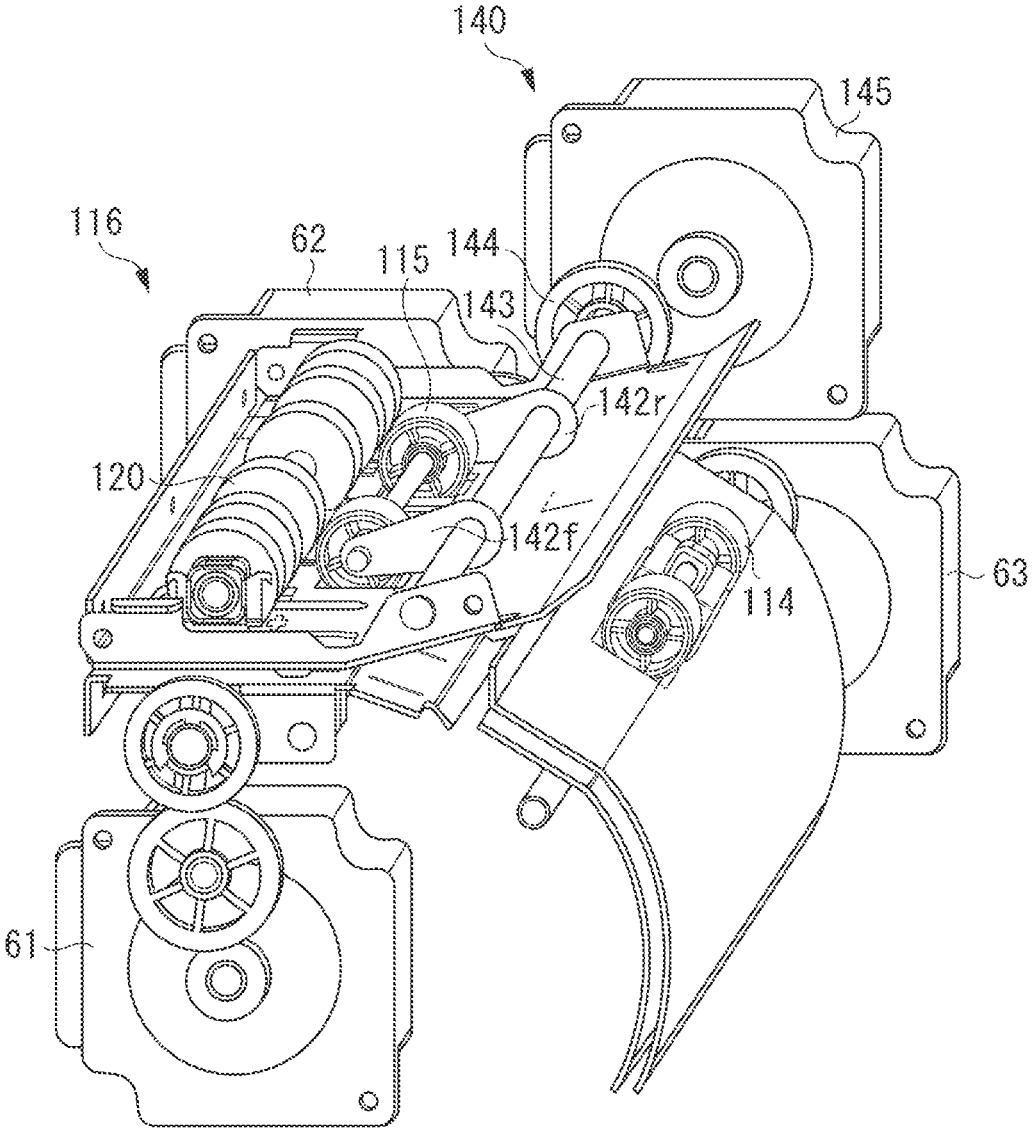
FIG. 1 is a perspective view illustrating a sheet conveying apparatus according to an exemplary embodiment of the present invention.
Figure 2A:
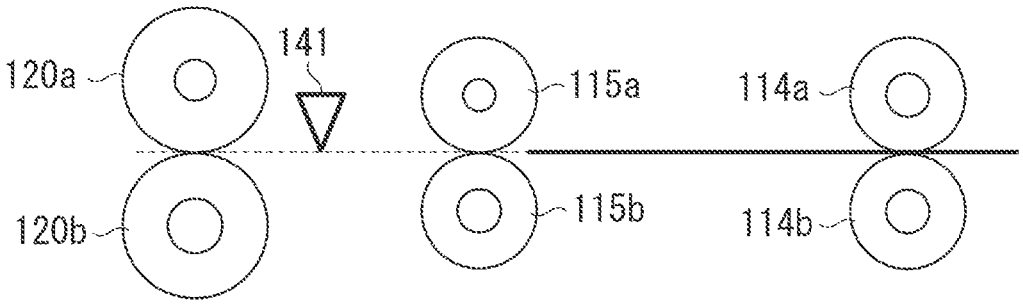
FIGS. 2A, 2B, and 2C are schematic views illustrating a skew correction operation according to a first exemplary embodiment of the present invention.

With reference to FIGS. 1, 2A, 2B, 2C, and 2D, the sheet conveying apparatus 116 according to the first exemplary embodiment will be described. FIG. 1 is a perspective view illustrating the sheet conveying apparatus 116 according to the first exemplary embodiment. The sheet conveying apparatus 116 is provided in a conveyance path connecting the sheet cassettes 111 and 112 and the image forming unit. FIG. 2A is a schematic cross-sectional view illustrating the sheet conveying apparatus 116 according to the first exemplary embodiment.

The first conveyance roller pair 115 provided in the conveyance path includes, as illustrated in FIG. 2A, a first conveyance lower roller 115*b* and a first conveyance upper roller 115*a*. The first conveyance lower roller 115*b* is a rubber roller. The first conveyance upper roller 115*a* is disposed to face the first conveyance lower roller 115*b*, and driven by the first conveyance lower roller 115*b* to rotate. The first conveyance upper roller 115*a* is swingably supported by an arm, or the like, and pressed against the first conveyance lower roller 115*b* by elastic force of a spring (not illustrated).

The second conveyance roller pair 114 provided upstream of the first conveyance roller pair 115 includes, similarly to the first conveyance roller pair 115, as illustrated in FIG. 2A, a second conveyance lower roller 114*b* and a second conveyance upper roller 114*a*. The second conveyance lower roller 114*b* is a rubber roller. The second conveyance upper roller 114*a* is disposed to face the second conveyance lower roller 114*b*, and driven by the second conveyance lower roller 114*b* to rotate. The second conveyance upper roller 114*a* is pressed against the second conveyance lower roller 114*b* by elastic force of a spring (not illustrated).

The third conveyance roller pair 120 is provided downstream of the first conveyance roller pair 115, and serves as a contact portion where the leading edge of a conveyed sheet comes in contact therewith, for sheet skew correction. As illustrated in FIG. 2A, the third conveyance roller pair 120 includes a third conveyance upper roller 120*a* and a third conveyance lower roller (registration lower roller) 120*b*. The leading edge of the sheet comes in contact with a nip portion (contact portion) of the third conveyance upper roller 120*a* and the third conveyance lower roller 120*b* so that the leading edge of the sheet fits along the nip portion, thereby correcting a skew of the sheet.

The third conveyance lower roller 120*b* is a rubber roller. The third conveyance upper roller 120*a* and the third conveyance lower roller 120*b* are disposed to face each other. The third conveyance upper roller 120*a* is pressed against the third conveyance lower roller 120*b* by elastic force of a spring (not illustrated).

A separation unit 140 separates the first conveyance upper roller 115*a* from the first conveyance lower roller 115*b*. The separation of the first conveyance upper roller 115*a* from the first conveyance lower roller 115*b* can reduce the force of the first conveyance roller pair 115 for nipping the sheet to zero. The separation unit 140 includes a first conveyance upper roller separation motor 145, an input gear 144, a driven shaft 143 for supporting the first conveyance upper roller 115*a*, and a separation lever front 142*f* and a separation lever rear 142*r* for separating the first conveyance upper roller 115*a* from the first conveyance lower roller 115*b*. An output gear of the first conveyance upper roller separation motor 145 engages with the input gear 144. The input gear 144 is fixed to an end portion of the driven shaft 143. The separation lever front 142*f* and the separation lever rear 142*r* fixed to the driven shaft 143 come in contact with the shaft of the first conveyance upper roller 115*a* from the under side.

With the mechanism, rotating the first conveyance upper roller separation motor 145 to the left in FIG. 1 (counterclockwise direction) by a predetermined amount drives the driven shaft 143 to rotate, and the movement rotates the separation lever front 142*f* and the separation lever rear 142*r* to the right (clockwise direction). The movement lifts the first conveyance upper roller 115*a* against the elastic force of the spring (not illustrated), and separates the first conveyance upper roller 115*a* from the first conveyance lower roller 115*b*. Rotating the first conveyance upper roller separation motor 145 in the opposite direction (clockwise direction) to the direction in the separation causes the separation lever front 142*f* and the separation lever rear 142*r* to rotate to the left (counterclockwise direction) via the driven shaft 143. Then, by the elastic force of the spring (not illustrated), the first conveyance upper roller 115*a* is pressed against the first conveyance lower roller 115*b* to come in contact with each other.

In FIG. 1, a first drive motor (a first conveyance roller drive motor serving as a first driving unit) 62 drives the first conveyance lower roller 115*b*, and a second drive motor (a second conveyance roller drive motor serving as a second driving unit) 63 drives the second conveyance lower roller 114*b*. As illustrated in the block diagram in FIG. 4, the control unit (central processing unit (CPU)) 50 is connected to the operation unit 200 in the image forming apparatus and the size detection unit 130. The control unit 50 is also connected to a registration sensor 141, the first conveyance upper roller separation motor 145, a registration motor 61, a sheet feeding motor 54, the first drive motor 62, and the second drive motor 63. The control unit 50 is also connected to a read-only memory (ROM) and a random access memory (RAM). The control unit 50 uses the RAM as a work memory to execute a program stored in the ROM. The control unit 50 controls the separation unit 140, based on the signal from the registration sensor 141.

Figure 2B:
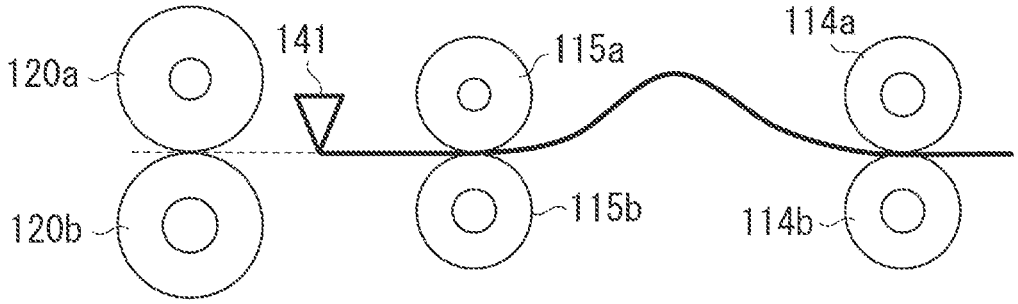
Figure 2C:
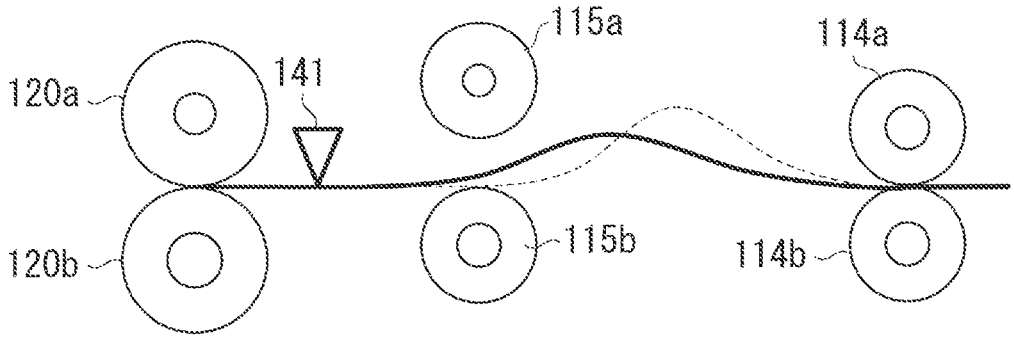

With reference to FIGS. 2A, 2B, 2C, 3A, 3B, 3C, and 3D, a skew correction operation according to the first exemplary embodiment will be described. FIGS. 2A, 2B, and 2C are schematic cross-sectional views illustrating the sheet conveying apparatus according to the first exemplary embodiment. FIGS. 3A, 3B, 3C, and 3D are views from the top. FIGS. 2A, 2B, and 2C correspond to FIGS. 3A, 3B, and 3C, respectively.

Figure 3A:
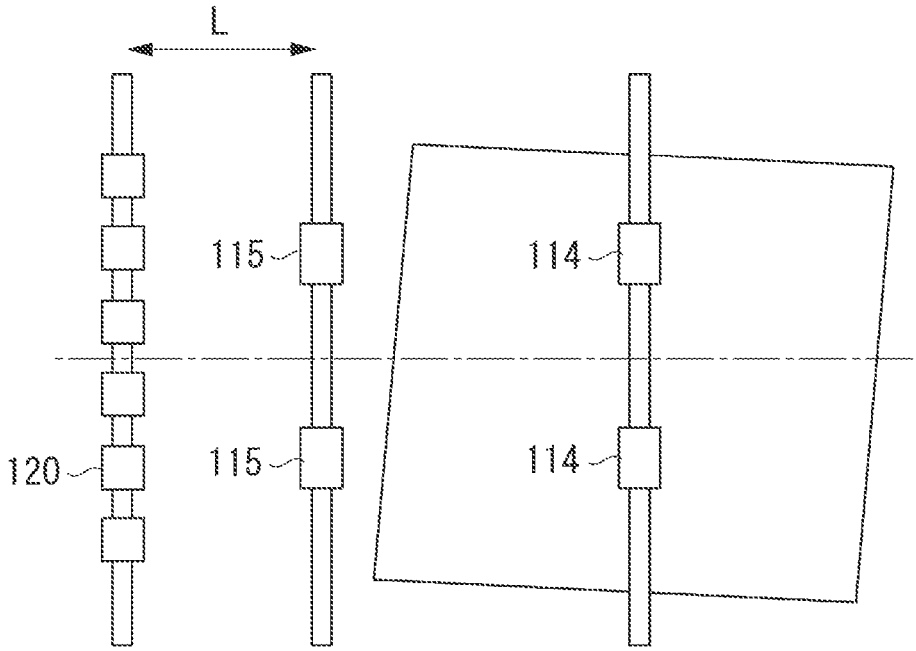
FIGS. 3A, 3B, 3C, and 3D are schematic views illustrating the skew correction operation according to the first exemplary embodiment of the present invention.

A skew correction operation to be performed when the sheet is skewed to the left side (front side) with respect to the conveyance direction, as illustrated in FIG. 3A, will be described.

First, the sheet fed from the sheet cassette 111 or 112 is nipped by the second conveyance roller pair 114, and conveyed toward the first conveyance roller pair 115. The sheet conveyed by the second conveyance roller pair 114 is then nipped by the first conveyance roller pair 115, and conveyed toward the third conveyance roller pair 120.

Figure 3B:
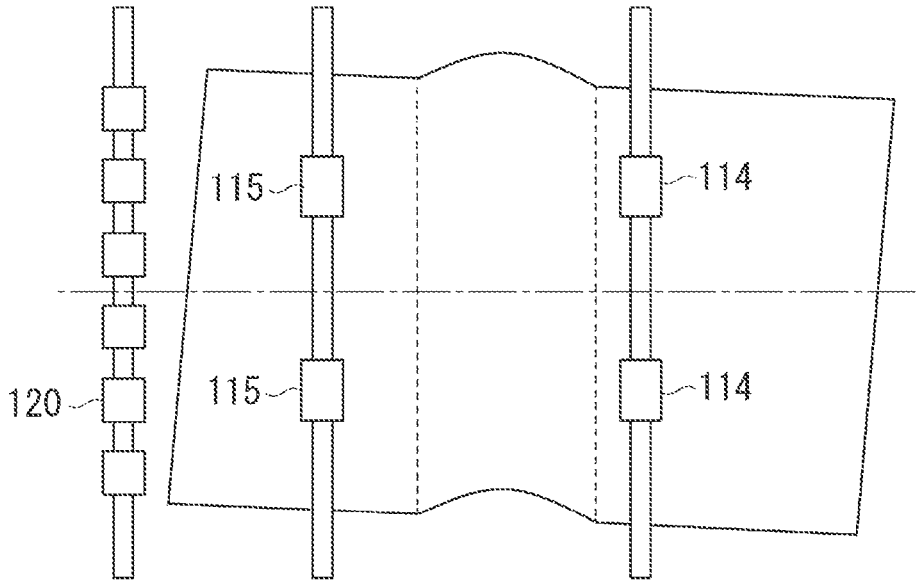

In this operation, the conveyance speed of the first conveyance roller pair 115 is set to a speed lower than the conveyance speed of the second conveyance roller pair 114. Consequently, as illustrated in FIGS. 2B and 3B, a loop (deformation) of the sheet is formed (the sheet deforms in a loop shape) between the first conveyance roller pair 115 and the second conveyance roller pair 114 while the sheet is conveyed for a conveyance distance L from the first conveyance roller pair 115 to the third conveyance roller pair 120 (before the leading edge of the sheet reaches the third conveyance roller pair 120).

In the first exemplary embodiment, the conveyance distance L from the first conveyance roller pair 115 to the third conveyance roller pair 120 is set to 15 mm to 30 mm in view of the stability in the conveyance of the separated sheet after the separation.

In the first exemplary embodiment, depending on the information about the sheet input by the user to the operation unit 200, the control unit 50 appropriately adjust the conveyance speed difference between the first conveyance roller pair 115 and the second conveyance roller pair 114. That is, the control unit 50 acquires the information about the sheet to be conveyed, and based on the acquired information about the sheet, the control unit 50 determines the speed difference between the conveyance speed of the sheet by the first conveyance roller pair 115 and the conveyance speed of the sheet by the second conveyance roller pair 114.

For example, in the first exemplary embodiment, a speed difference for a sheet having a large grammage to be conveyed is set to a value larger than a speed difference for a sheet having a small grammage to be conveyed. This is because, for the sheet having the large grammage, the sheet may slip at the nip portion of the second conveyance roller pair 114, and thus it is difficult to form a loop.

Through this adjustment, in the first exemplary embodiment, a loop can be appropriately formed depending on the type of the sheet to be conveyed.

Figure 3C:
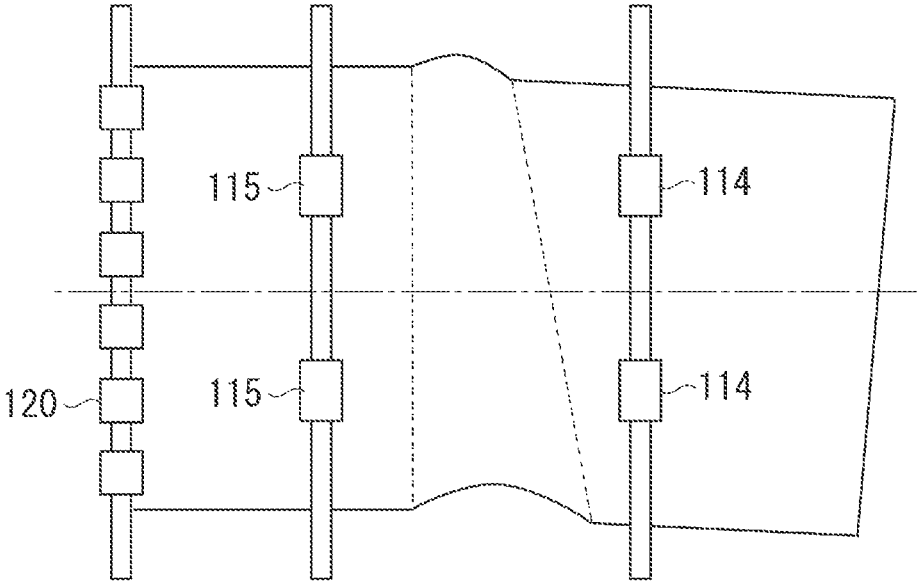

Then, as illustrated in FIGS. 2C and 3C, after the detection of the leading edge of the sheet by the registration sensor 141, the first conveyance roller pair 115 is separated by the separation unit 140 at a predetermined timing. The registration sensor 141 is disposed between the first conveyance roller pair 115 and the third conveyance roller pair 120. The registration sensor 141 is disposed at the position to prevent variation in the positions of the leading edge of the sheet conveyed by the first conveyance roller pair 115 due to effects of the slip caused during the loop formation of the thick paper. To adjust the leading edge of the sheet to the leading edge of the image, in addition to the registration sensor 141, another sensor can be provided at a position downstream of the third conveyance roller pair 120.

The first conveyance roller pair 115 is thus separated, so that the sheet is conveyed by the force of the sheet to return from the loop state to a flat state (hereinafter, referred to as loop resistance) and the conveyance force of the second conveyance roller pair 114.

In the conveyance, the left side (front side) of the sheet advancing ahead comes in contact with the nip portion of the third conveyance roller pair 120 earlier than the right side (rear side). At the time, the rotation of the third conveyance roller pair 120 is being stopped. Then, the right end portion advancing behind comes in contact with the nip portion of the third conveyance roller pair 120 and the skew of the sheet is corrected. The sheet is conveyed while being twisted in the loop, thereby correcting the skew.

Figure 3D:
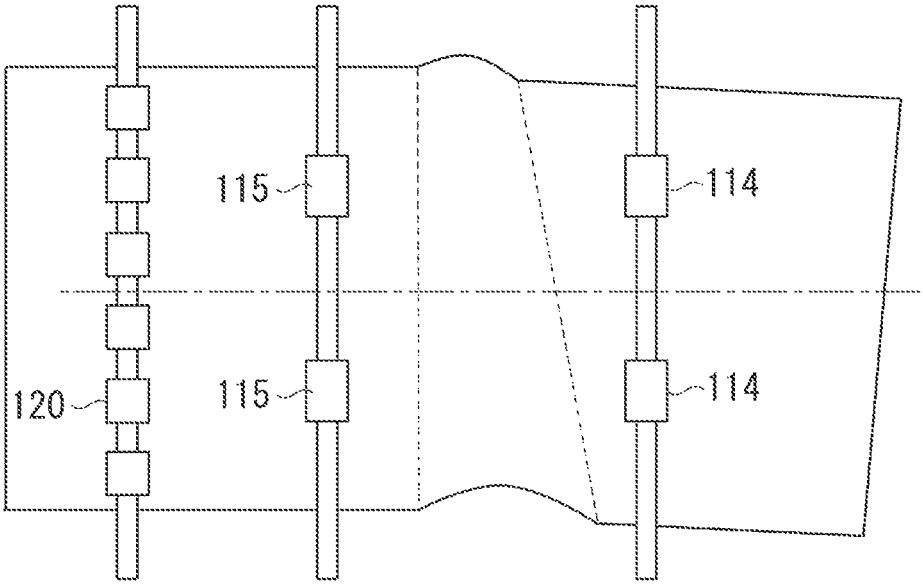

Then, the third conveyance roller pair 120, which is in a non-rotating state, starts the rotation, and as illustrated in FIG. 3D, the sheet is conveyed with the skew having been corrected.

For a sheet having a large grammage (a sheet having large stiffness, for example, thick paper), the loop formation force necessary to start forming a loop from a flat state is considerably large as compared to that of plain paper. If the loop formation force exceeds the sheet nipping force of the second conveyance roller pair 114, the sheet slips at the nip portion of the second conveyance roller pair 114, and this may cause a decrease in the conveyance amount of the second conveyance roller pair 114, and a failure in the formation of a loop of a desired size of the sheet.

If the loop formation operation by the second conveyance roller pair 114 is continued until the desired loop is formed, the stop time of the third conveyance roller pair 120 (the time period for which the sheet stops at the nip portion of the third conveyance roller pair 120) increases, making it difficult to achieve high-productivity of the image formation.

Increasing the conveyance speed of the second conveyance roller pair 114 during the loop formation can reduce the loop formation time. However, this causes the leading edge of the sheet to come in contact with the nip portion of the third conveyance roller pair 120 at high speed. That is, this may increase the sound generated at the contact operation, or may cause damages such as a bend at the leading edge of the sheet. Consequently, during the loop formation, it is desirable to set the conveyance speed of the second conveyance roller pair 114 at a low speed.

In view of the foregoing, in the first exemplary embodiment, before the leading edge of the sheet comes in contact with the third conveyance roller pair 120, a loop is formed during the conveyance between the first conveyance roller pair 115 and the second conveyance roller pair 114. During the conveyance, the loop formation is performed taking advantage of a conveyance speed difference between the conveyance speed of the first conveyance roller pair 115 and that of the second conveyance roller pair 114. Consequently, the loop can be gradually formed during the conveyance. As described above, according to the first exemplary embodiment, for thick paper, a desired loop can be formed without extending the stop time of the third conveyance roller pair 120, and thus the skew correction ability for thick paper can be increased.

Further, in the first exemplary embodiment, before the leading edge of the sheet comes in contact with the nip portion of the third conveyance roller pair 120, the first conveyance roller pair 115 is separated. This can weaken the force of the sheet in coming in contact with the nip portion of the third conveyance roller pair 120, and prevent the leading edge of the sheet from being stuck into the nip portion. This is because the sheet comes in contact with the nip portion of the third conveyance roller pair 120 in the looped state by forming the loop of the sheet between the second conveyance roller pair 114 and the first conveyance roller pair 115, and separating the first conveyance roller pair 115. On the other hand, in the state where the first conveyance roller pair 115 is being pressed, the sheet is linearly conveyed and the force of the third conveyance roller pair 120 in coming in contact with the nip portion is large.

Figure 5:
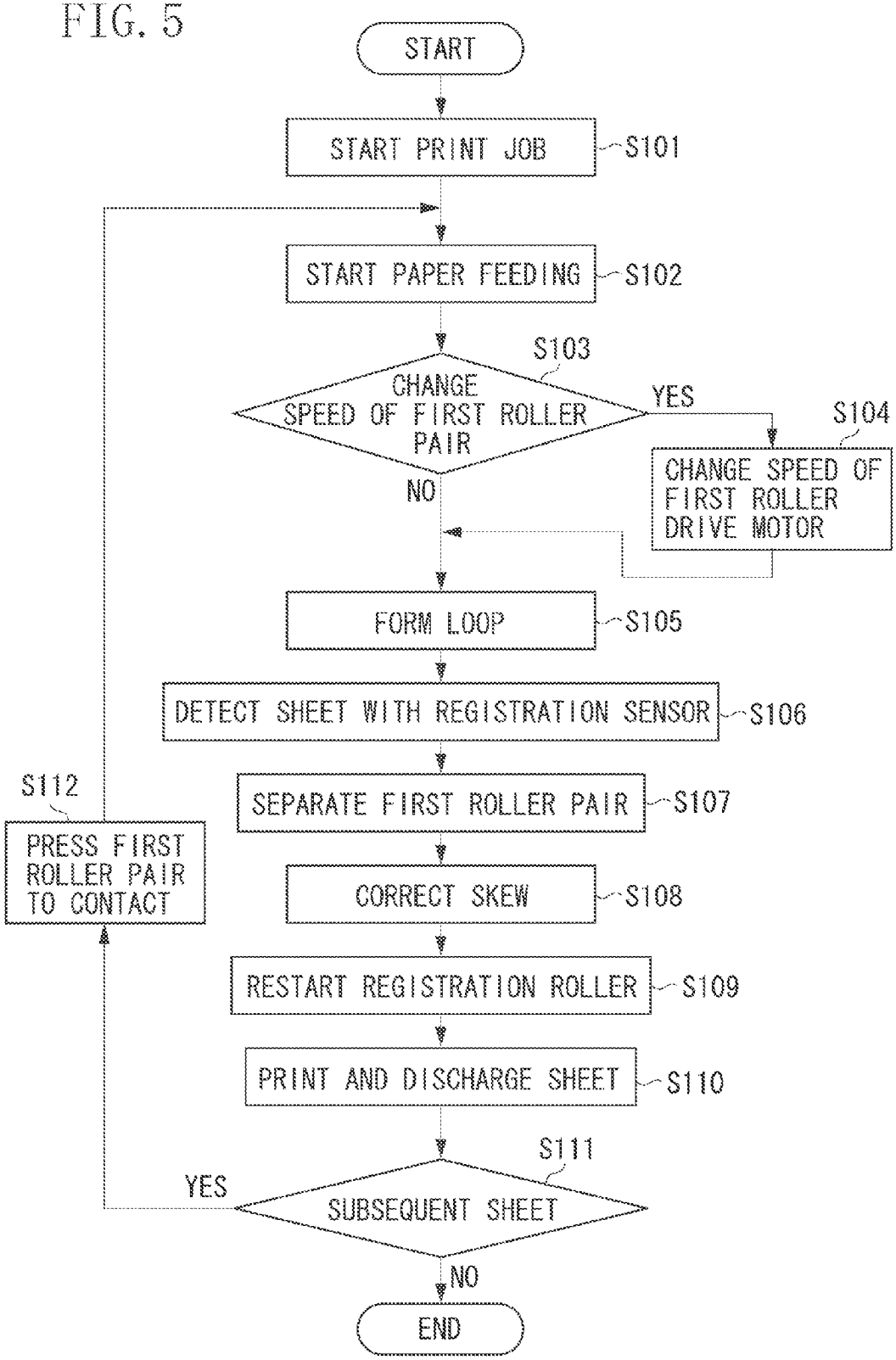
FIG. 5 is a flowchart illustrating a skew correction operation performed by a sheet conveying apparatus according to an exemplary embodiment of the present invention.
Figure 6:
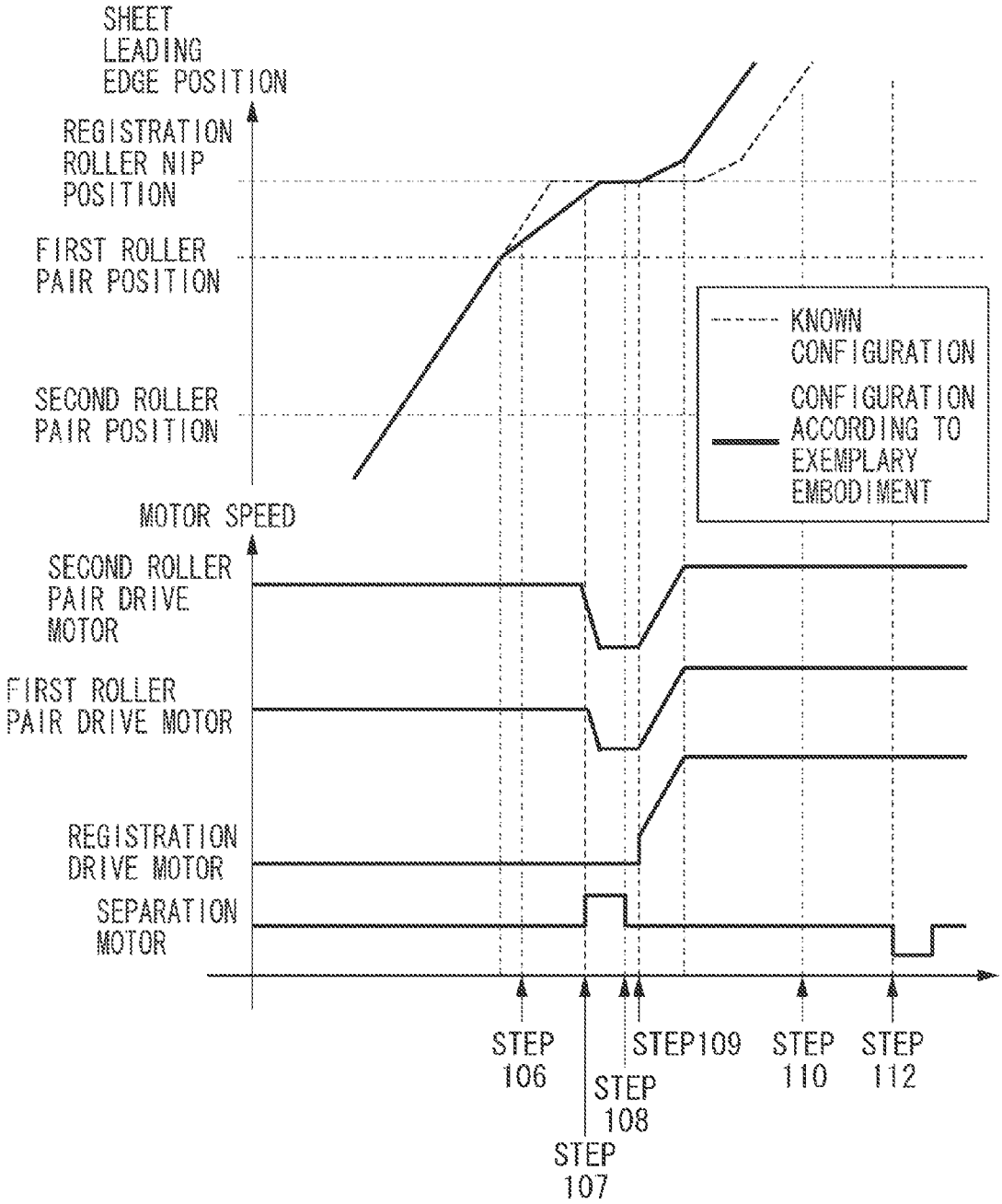
FIG. 6 illustrates conveyance chart of the leading edge of a sheet and driving chart of motors according to an exemplary embodiment of the present invention.
Figure 7:
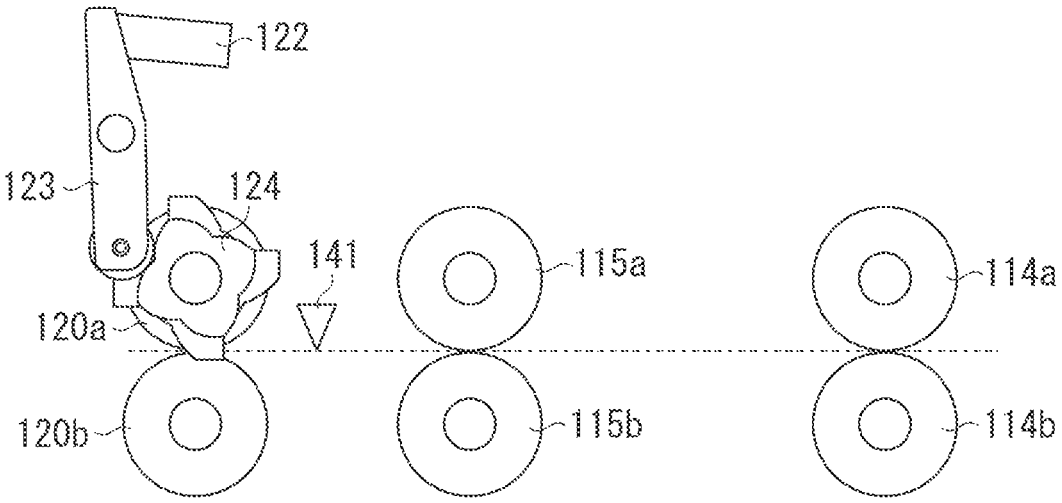
FIG. 7 is a schematic cross-sectional view illustrating a second exemplary embodiment of the present invention.

With reference to FIG. 5, the flow of the sheet skew correction operation performed by the sheet conveying apparatus 116 will be described. The sheet conveying apparatus 116 according to the first exemplary embodiment 116 includes the units illustrated in the block diagram in FIG. 4. FIG. 6 illustrates the conveyance chart of the leading edge positions and the driving chart of the registration motor 61, the first conveyance roller drive motor 62, and the second conveyance roller drive motor 63, which correspond to the steps in FIG. 5.

In step 5101, a user executes a print job from the operation unit 200 of the image forming apparatus or the computer 201 connected directly or via a network to the image forming apparatus. In this operation, the user can specify the number of sheets to be printed and sheet information about the sheet to be used. Further, by the size detection unit 130, the sheet information can be detected.

In step 5102, in response to the execution of the print job, the sheet feeding operation is started. In step S103, based on the sheet information specified by the user, whether to change the conveyance speed of the first conveyance roller pair is determined.

In step S104, when feeding thin paper or plain paper that can be easily looped, the control unit 50 sets the speed so that the conveyance speed difference between the first conveyance roller pair 115 and the second conveyance roller pair 114 is small. On the other hand, when setting a conveyance speed for thick paper that is hard to be looped, the control unit 50 sets the speed so that the conveyance speed difference between the first conveyance roller pair 115 and the second conveyance roller pair 114 is large. In step S105, the sheet is conveyed to the second conveyance roller pair 114, the first conveyance roller pair 115, and then to the third conveyance roller pair 120 while a loop is formed between the first conveyance roller pair 115 and the second conveyance roller pair 114.

In step S106, the registration sensor 141 detects the conveyed sheet, and after a predetermined period of time has passed, in step S107, the separation unit 140 separates the first conveyance roller pair 115.

After the first conveyance roller pair 115 is separated, in step S108, the sheet comes in contact with the nip portion of the third conveyance roller pair 120 which is in a non-rotating state, so that the skew is corrected. In step S109, the rotation of the third conveyance roller pair 120 in the non-rotating state is restarted. In step S110, the sheet is conveyed to a secondary transfer unit located downstream of the roller pair while the state where the skew has been corrected is maintained, and an image transfer operation and a sheet discharge operation are performed.

In step S111, the controller 50 determines whether a subsequent sheet exists. If a subsequent sheet exists (YES in step S111), in step S112, after the trailing edge of the preceding sheet passed through the first conveyance roller pair 115, and before the leading edge of the subsequent sheet reaches the first conveyance roller pair 115, the first conveyance roller pair 115 is pressed to contact. If a subsequent sheet does not exist (NO in step S111), the print job ends.

Next, the loop formation success rate in the first exemplary embodiment will be described. FIG. 6 illustrates a comparison of the sheet leading edge positions between a comparison example and the first exemplary embodiment when forming a loop of the sheet with a loop amount of 5 mm. In FIG. 6, the broken lines indicate positions of the leading edge of the sheet in the comparative example and the solid lines indicate positions of the leading edge of the sheet in the first exemplary embodiment.

In a skew correction sequence in the comparative example, the leading edge comes in contact with the third conveyance roller pair 120, and a loop of the sheet is formed in a state where the leading edge is stopped. As described above, it is desirable that the conveyance speed of the second conveyance roller pair 114 for bringing the leading edge of the sheet into contact with the third conveyance roller pair 120 is set to a low speed.

That is, the productivity depends on the stop time of the third conveyance roller pair 120. It is necessary to stop the rotation of the third conveyance roller pair 120 after the preceding sheet is conveyed and before the leading edge of the subsequent sheet reaches the roller pair. Considering the characteristics of the motors during this operation, there is a limit to enhance the productivity by increasing the conveyance speed of the third conveyance roller pair 120 after the formation of the loop.

In the first exemplary embodiment, as indicated by the solid lines in FIG. 6, before the leading edge of the sheet reaches the nip portion (contact portion) of the third conveyance roller pair 120, a loop of the sheet is formed taking advantage of the conveyance speed difference during the conveyance between the first conveyance roller pair 115 and the second conveyance roller pair 114. Consequently, the stop time of the third conveyance roller pair 120 can be shortened.

In the first exemplary embodiment, by adjusting the speed difference during the conveyance in which there is no limitation in the increase and decrease of the speed, the apparatus can handle various types of media. Further, in a state where the loop is formed in advance, the leading edge of the sheet is caused to hit the nip portion of the third conveyance roller pair 120, and by the loop resistance of the sheet to return to the flat state, the entire sheet leading edge portion is brought into contact with the nip portion.

In the example illustrated in FIG. 6, the control unit 50 reduces the conveyance speed of the first conveyance roller pair 115. However, the present invention is not limited to this example. In an exemplary embodiment of the present invention, the conveyance speed of the second conveyance roller pair 114 may be increased.

For example, in the comparative example, it is assumed that the conveyance speed of the second conveyance roller pair 114 before the speed reduction is 650 mm/s, and the conveyance speed of the second conveyance roller pair 114 after the speed reduction (speed at the loop formation) is 120 mm/s. In this case, the time necessary to form a loop with a loop amount of 5 mm starting from a position upstream of the third conveyance roller pair 120 by 20 mm and to start the rotation of the third conveyance roller pair 120 is about 82 ms.

Meanwhile, in the first exemplary embodiment, it is assumed that the conveyance speed of the first conveyance roller pair 115 is 430 mm/s, and the conveyance speed of the second conveyance roller pair 114 is 650 mm/s, and the speed difference between the roller pairs is 220 mm/s. Further, it is assumed that the distance between the nips of the first conveyance roller pair 115 and the second conveyance roller pair 114 is 20 mm. In this case, the time necessary to form a loop with a loop amount of 5 mm starting from the nip position of the first conveyance roller pair 115 and to start the rotation of the third conveyance roller pair 120 is about 56 ms.

As described above, in the first exemplary embodiment. the time necessary for the loop formation can be substantially reduced.

Next, a second exemplary embodiment will be described. FIGS. 7, 8A, 8B, 8C, and 8D are schematic cross-sectional views illustrating a sheet conveying apparatus according to the second exemplary embodiment. In the second exemplary embodiment, different from the first exemplary embodiment, the skew correction is performed using a shutter member 121. In the description of the second exemplary embodiment provided below, descriptions of configurations and operations similar to those in the first exemplary embodiment are omitted.

In the second exemplary embodiment, as a skew correction configuration of the third conveyance roller pair, a shutter mechanism is used. The shutter member 121 is rotatably disposed in a stop orientation (FIG. 8A) for stopping the sheet or in a passing orientation (FIG. 8D) for allowing the sheet to pass through. With an urging unit 122, an arm 123, and a cam 124 illustrated in FIG. 7, the shutter member 121 is urged to maintain the stop orientation. A sheet stop position (a position B in FIG. 8A) of the shutter member 121 being urged in the stop orientation is located at the upstream side of the nip portion of the third conveyance roller pair 120 (a position A in FIG. 8A).

The first conveyance lower roller 115*b* and the registration lower roller 120*b* are driven by the same drive source (the registration motor 61).

Figure 8A:
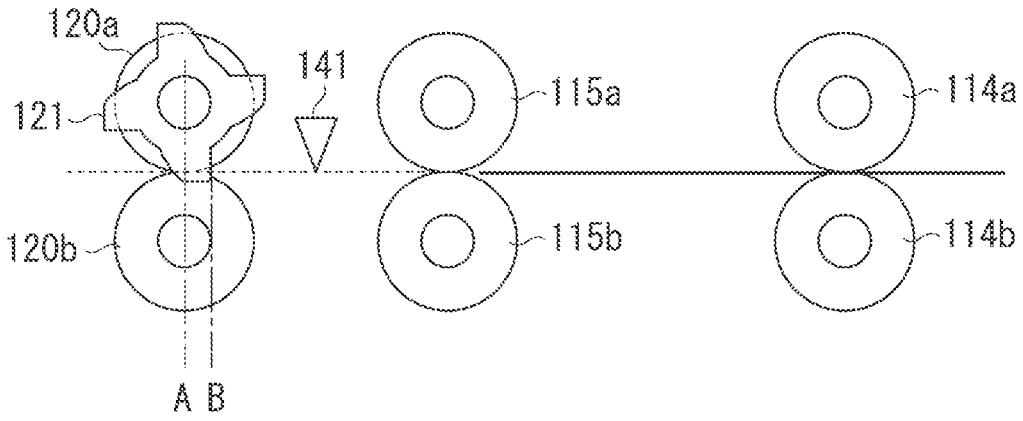
FIGS. 8A, 8B, 8C, and 8D are schematic views illustrating a skew correction operation according to the second exemplary embodiment of the present invention.

Next, as illustrated in FIG. 8A, a skew correction operation to be performed with the shutter mechanism when the sheet is skewed to the left side with respect to the conveyance direction will be described.

Figure 8B:
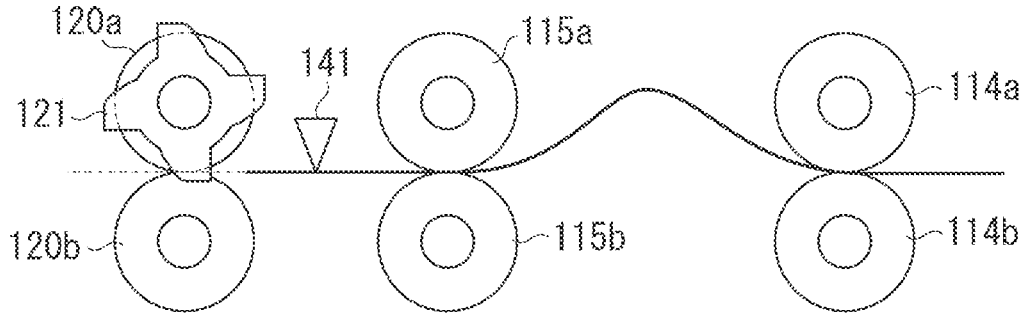
Figure 8C:
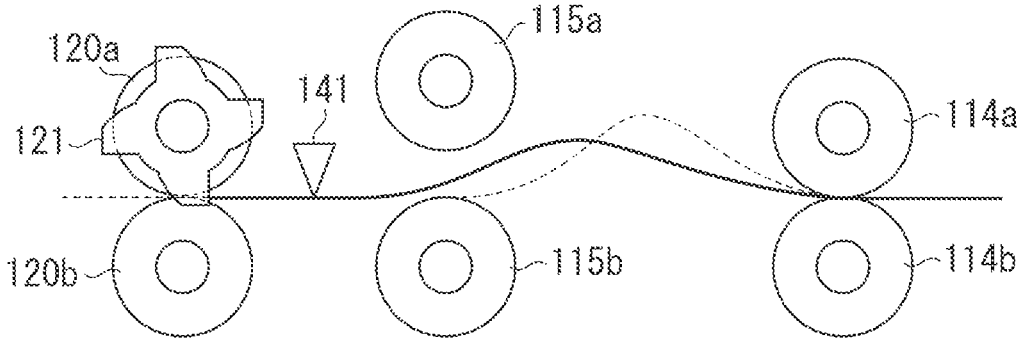

As illustrated in FIGS. 8A and 8B, in the second exemplary embodiment, similarly to the first exemplary embodiment, a loop of the sheet is formed between the first conveyance roller pair 115 and the second conveyance roller pair 114. Then, as illustrated in FIG. 8C, after a predetermined period of time has passed from the detection of the leading edge of the sheet by the registration sensor 141, the first conveyance roller pair 115 is separated by the separation unit 140.

The leading edge of the sheet is conveyed toward the shutter member 121 by the loop resistance and the conveyance force of the second conveyance roller pair 114.

First, the left end portion of the sheet advancing ahead comes in contact with the shutter member 121, and then, the right end portion of the sheet advancing behind comes in contact with the shutter member 121, and the entire leading edge portion of the sheet fits along the shutter member 121 to correct the skew. The twist generated due to the turn of the leading edge of the sheet is absorbed in the space of the loop formed in advance.

Figure 8D:
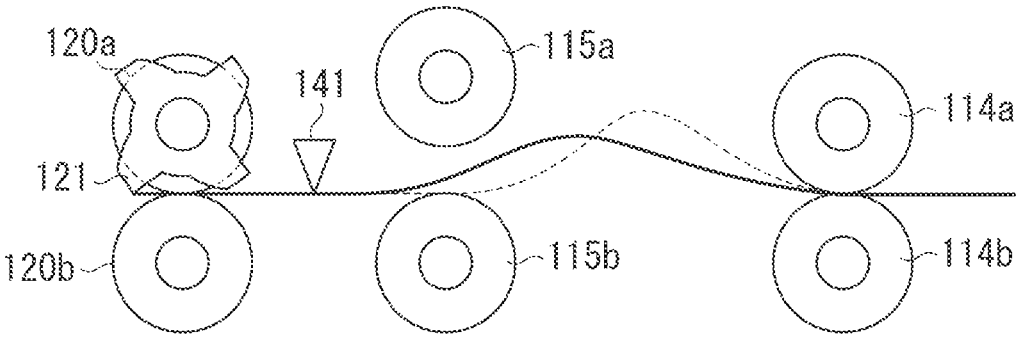

Then, as illustrated in FIG. 8D, when the pressing force acting on the sheet leading edge portion exceeds the stopping force of the shutter member 121, the shutter member 121 rotates from the stop position to the passing position. The leading edge portion of the sheet is nipped by the third conveyance roller pair 120, and the sheet is conveyed with the skew having been corrected.

The separation timing of the first conveyance roller pair 115 by the separation unit 140 can be any timing while the urging force of the urging unit 122 for urging the shutter member 121 to remain at the stop position is acting. The range in which the urging force of the urging member 122 acts is set to a range in which the leading edge of the sheet is located upstream of the nip portion of the third conveyance roller pair 120.

In the skew correction configuration with the shutter member 121, after the leading edge of the sheet hits against the shutter member 121 held by a predetermined urging force, a loop of the sheet is formed, thereby correcting the skew of the sheet. Then, when the force of the leading edge of the sheet pressing the shutter member 121 exceeds the above-described urging force, the sheet turns the shutter member 121 to pass therethrough. The strength of the force of the leading edge of the sheet pressing the shutter member 121 differs between thin paper and thick paper. The pressing force of thin paper is weak while the pressing force of the thick paper is strong. Consequently, since the force necessary to urge the shutter member 121 differs between thin paper and thick paper, it is difficult to perform the skew correction on various types of media.

In view of the foregoing, in the second exemplary embodiment, when thick paper is conveyed, before the leading edge portion of the sheet hits against the shutter member 121, a loop of the sheet is formed, and the first conveyance roller pair 115 is separated. By the operation, the force of the thick paper pressing the shutter member 121 can be weakened. Further, when thin paper is conveyed, if the force to press the shutter member 121 is to be ensured, the separation of the first conveyance roller pair 115 can be omitted. That is, the control unit 50 can acquire the information about the sheet to be conveyed, and based on the acquired information about the sheet, the control unit 50 can determine whether to perform separation of the first conveyance roller pair 115 by the separation unit 140.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-152793 filed Jul. 23, 2013, which is hereby incorporated by reference herein in its entirety.

What is claimed is:

1. A sheet conveying apparatus comprising:

a first conveyance roller pair configured to convey a sheet;

a second conveyance roller pair disposed upstream of the first conveyance roller pair and configured to convey the sheet;

a contact portion disposed downstream of the first conveyance roller pair and configured to contact the conveyed sheet;

a third conveyance roller pair disposed downstream of the first conveyance roller pair and configured to convey the sheet with a skew having been corrected by contacting the contact portion;

a separation unit configured to separate the first conveyance roller pair; and a control unit configured to control a conveyance speed of the sheet conveyed by the first conveyance roller pair, a conveyance speed of the sheet conveyed by the second conveyance roller pair, and the separation unit, wherein the control unit forms a loop of the sheet between the first conveyance roller pair and the second conveyance roller pair, and separates the first conveyance roller pair before a leading edge of the sheet reaches the contact portion.

2. The sheet conveying apparatus according to claim 1, further comprising:

a first driving unit configured to drive the first conveyance roller pair; and a second driving unit configured to drive the second conveyance roller pair, wherein the control unit controls the conveyance speed of the sheet conveyed by the first conveyance roller pair by controlling the first driving unit, and controls the conveyance speed of the sheet conveyed by the second conveyance roller pair by controlling the second driving unit.

3. The sheet conveying apparatus according to claim 1, wherein the control unit acquires information about the sheet to be conveyed, and based on the acquired information about the sheet, the control unit determines a speed difference between the conveyance speed of the sheet conveyed by the first conveyance roller pair and the conveyance speed of the sheet conveyed by the second conveyance roller pair.

4. The sheet conveying apparatus according to claim 3, wherein the control unit sets, in a case where the sheet to be conveyed has a third grammage, the speed difference to a speed difference larger than a speed difference to be set in a case where the sheet to be conveyed has a fourth grammage that is smaller than the third grammage.

5. The sheet conveying apparatus according to claim 1, wherein the control unit acquires information about the sheet to be conveyed, and based on the acquired information about the sheet, the control unit determines whether to perform separation of the first conveyance roller pair by the separation unit.

6. The sheet conveying apparatus according to claim 5, wherein the control unit determines to perform the separation of the first conveyance roller pair by the separation unit in a case where the sheet to be conveyed has a first grammage, and determines not to perform the separation of the first conveyance roller pair by the separation unit in a case where the sheet to be conveyed has a second grammage that is smaller than the first grammage.

7. The sheet conveying apparatus according to claim 1, wherein the control unit brings the first conveyance roller pair into contact with each other after a trailing edge of a preceding sheet being conveyed by the third conveyance roller pair with the skew having been corrected has passed through the first conveyance roller pair, and before a leading edge of a subsequent sheet to be conveyed next to the preceding sheet reaches the first conveyance roller pair.

8. The sheet conveying apparatus according to claim 1, wherein the first conveyance roller pair and the third conveyance roller pair are driven by a same driving source.

9. The sheet conveying apparatus according to claim 1, wherein the contact portion is a nip portion of the third conveyance roller pair.

10. The sheet conveying apparatus according to claim 1, wherein the contact portion includes a shutter provided upstream of a nip portion of the third conveyance roller pair.

11. An image forming apparatus comprising:

the sheet conveying apparatus according to claim 1; and an image forming unit provided downstream of the sheet conveying apparatus and configured to form an image on a sheet.

* * * * *